US007581566B2

(12) United States Patent
Mettler

(10) Patent No.: US 7,581,566 B2
(45) Date of Patent: Sep. 1, 2009

(54) HEDDLE FOR BAND-SHAPED WARP THREADS

(75) Inventor: Franz Mettler, Wollerau (CH)

(73) Assignee: Groz-Beckert KG, Albstadt (DE)

( * ) Notice: Subject to any disclaimer, the term of this patent is extended or adjusted under 35 U.S.C. 154(b) by 182 days.

(21) Appl. No.: 11/635,612

(22) Filed: Dec. 8, 2006

(65) Prior Publication Data

US 2007/0131301 A1 Jun. 14, 2007

(30) Foreign Application Priority Data

Dec. 8, 2005 (EP) ..... 05026813

(51) Int. Cl.
*D03C 9/00* (2006.01)

(52) U.S. Cl. ..... 139/93

(58) Field of Classification Search ..... 139/90–96
See application file for complete search history.

(56) References Cited

U.S. PATENT DOCUMENTS

| | | | | | |
|---|---|---|---|---|---|
| 825,244 | A * | 7/1906 | Russell | ..... | 139/96 |
| 1,930,152 | A * | 10/1933 | Smith | ..... | 139/94 |
| 1,932,350 | A * | 10/1933 | Marx | ..... | 139/93 |
| 2,147,258 | A * | 2/1939 | Kaufmann | ..... | 28/212 |
| 3,304,958 | A * | 2/1967 | Koch | ..... | 139/96 |
| 3,960,182 | A * | 6/1976 | Schwarz | ..... | 139/91 |
| 6,145,549 | A * | 11/2000 | Euerle et al. | ..... | 139/93 |
| 6,283,163 | B1 * | 9/2001 | Kagi | ..... | 139/93 |
| 2002/0033198 | A1 | 3/2002 | Nahir | | |

FOREIGN PATENT DOCUMENTS

| | | |
|---|---|---|
| DE | PS 22996 | 6/1882 |
| FR | 394 156 | 11/1908 |
| GB | 108 188 | 4/1934 |

* cited by examiner

*Primary Examiner*—Shaun R Hurley
*Assistant Examiner*—Andrew W Sutton
(74) *Attorney, Agent, or Firm*—Fitch, Even, Tabin & Flannery; Norman N. Kunitz

(57) ABSTRACT

A heddle (1) for flat, band-shaped warp threads (36) is provided with a thread eyelet (7), for which the width preferably exceeds the height. A thread eyelet (7) of this type prevents a deformation of the band-shaped warp thread (36), in particular a compressing on the sides during the shed formation. In addition, the heddle (1) according to the invention is preferably provided with thread guiding surfaces, which are longer than the thickness of the heddle (1) body (3), relative to the running direction of the warp thread. As a result of these measures, the wear on the heddle (1) as well as the warp thread (36) can be reduced.

11 Claims, 4 Drawing Sheets

HEDDLE FOR BAND-SHAPED WARP THREADS

CROSS REFERENCE TO RELATED APPLICATION

This application claims the priority of European Patent Application No. 05 026 813.5, filed on Dec. 8, 2005, the subject matter of which, in its entirety, is incorporated herein by reference.

BACKGROUND OF THE INVENTION

The invention relates to a heddle, designed for the processing of warp threads, which are embodied in the form of bands.

Textiles are produced with weaving looms having at least one, as a rule many, weaving shafts for the shed forming. Each weaving shaft is a substantially rectangular frame, consisting of vertically arranged side supports, as well as an upper and a lower transverse bar, the so-called shaft bar. The shaft bars hold heddle support rails, which for the most part are elongated steel rails with a rectangular cross section. The steel rails are designed to hold the heddles. Each heddle is provided with end eyelets for threading it onto the upper and the lower steel rail. The heddle body extends between the end eyelets. A thread eyelet is provided approximately in the center through which the warp thread is guided. If the shaft bar is moved up or down, all warp threads extending through the thread eyelet of the heddles are moved out of the warp bundle, either up or down, so that a weaving shed is created.

French patent document FR 394 156 discloses a heddle of this type, which is fashioned from flat steel strip, wherein the flat sides of the steel strip are oriented in warp thread direction. For producing a thread eyelet, the heddle is compressed in this region, with holes punched in. The thread eyelet created in this way has a height, measured in vertical direction, which exceeds the width measured in horizontal direction, wherein the thread eyelet is oriented in warp thread movement direction.

German patent document DE-PS 22996 also discloses a heddle with a thread eyelet oriented in warp thread movement direction. The heddle consists of two thin layers of sheet metal, which are positioned parallel and one above the other. In the thread eyelet region, the sheet metal strips are curved away from each other, wherein the heddle is twisted in longitudinal direction, so that the thread eyelet is oriented transverse to the end eyelets.

The heddles presented herein are designed for processing essentially round threads. These days, however, the requirement of processing band-shaped fiber arrangements must increasingly be met. Frequently, band-shaped thread arrangements must be processed, which are composed of polyester, aramide, or carbon fibers and are used, for example, for producing textiles to reinforce high-stress composite structures, wherein it is frequently required that the band-shaped fiber arrangement retains the band shape during the weaving operation and is oriented, for example, parallel to the textile plane.

Based on this, it is the object of the present invention to provide a heddle that is suitable for the weaving of band-shaped warp threads.

SUMMARY OF THE INVENTION

The above is object is solved with the heddle according to claim 1, as well as with the heddle according to claim 2.

The heddle according to the invention, as defined in claim 1, is provided with a heddle body with thread eyelet, which is wider as seen in warp thread direction than it is high. Insofar, the shape of the thread eyelet is approximately adapted to the shape of the warp thread band or a corresponding warp thread group, which is here considered a warp thread. The width of the thread eyelet is larger by at least a few tenth of millimeters than the width of the band-shaped warp thread for which the respective heddle is intended. As a result, a flat band-shaped warp thread can run unhindered through the thread eyelet and is securely guided in the thread eyelet with little vertical play.

Regardless of this measure, it is advantageous according to claim 2 to provide the thread eyelet on the upper and the lower edge with a thread guiding surface that is rounded on the thread inlet and/or the thread outlet side, wherein the length of the thread guiding surface extending in warp thread direction exceeds the thickness of the heddle body to be measured in the same direction. The heddle body can be embodied relatively thin and can consist, for example, of sufficiently strong steel. The danger that sharp edges form as a result on the thread eyelet, which could damage sensitive threads, is prevented by the thread guiding surface according to the invention. The thickness of the heddle can thus be reduced to a minimum, which results in reducing the weight of the heddles and thus also the material costs while also achieving a higher operating speed.

The heddle is preferably twisted at least in the region of the thread eyelet, so as to be positioned transverse to the warp thread, meaning the flat sides of the heddle are positioned in a single plane that also contains the two heddle support rails, or at least encloses together with these an extremely. acute angle near 0°. As a result, it is achieved that the opening direction of the thread eyelet essentially coincides with the movement direction of the warp thread. The required opening width for the thread eyelet can consequently be kept to a minimum.

To form a shed, for example, a first weaving shaft is moved downward into the lowest position and a second weaving shaft is moved upward into the upper position. Both weaving shafts are provided with heddles according to the invention, with warp threads running through their thread eyelets. Following the movement of the first weaving shaft to the lower position and the second weaving shaft to the upper position, a warp thread of the first weaving shaft and a warp thread of the second weaving shaft jointly form a so-called weaving shed. The warp thread of the first weaving shaft extends through a thread eyelet on a heddle of the first weaving shaft in the lower region, wherein the warp thread of the second shaft runs through an eyelet on a heddle of the second weaving shaft in the upper region, thereby forming a weaving shed. Following the weft shot into this weaving shed, the two weaving shafts change their positions. The first weaving shaft moves upward while, at the same time, the second weaving shaft moves downward. Along with the weaving shafts, the heddles also change positions and thus also the warp threads or warp thread bundles running through the thread eyelets of the heddles. During this position change of the warp threads, the warp thread of the second weaving shaft slides by the outside edge of the adjacent heddle of the first weaving shaft. Conversely, the warp thread running through the thread eyelet of the first weaving shaft passes by the outside edge of the adjacent heddle of the second weaving shaft.

Since the thread eyelet of a heddle according to the invention is turned transverse to the warp thread, the region between the outside edge of the heddle and the thread eyelet can be embodied extremely small, thereby providing sufficient room for a warp thread band of an adjacent heddle of an adjacent weaving shaft during the position change, so that it can pass unhindered by the edge of the heddle of the adjacent weaving shaft. The danger of damaging warp threads during the position change is thus strongly reduced and tightly knitted textile materials can additionally be produced. For the same purpose of forming tightly knit textiles, the heddle body can be positioned at a slight angle in the region of the thread eyelet, wherein the opening angle of the thread eyelet is inclined at an acute angle of only a few degrees, relative to the plane mentioned in claim 3.

The heddle body preferably consists of a band-shaped material, e.g. a steel band, which can be oriented transverse to the warp thread, at least at the thread eyelet. The turning angle between thread eyelet and end eyelets is preferably 90°, which allows achieving the above described conditions and advantages.

The end eyelet can be embodied as separate element that is connected to the heddle body. However, it is preferably formed integrally with the heddle body, meaning it consists of the same material as the heddle body and transitions seamless and smoothly into this body. The heddle consequently can be produced as a simple stamped body. The end eyelet can optionally be O-shaped, C-shaped or J-shaped, or can have any form developed in the future.

It is also possible to produce the heddle without twisting from a flat material, wherein the end eyelets are formed with projections, which are attached to the heddle body and project over its flat side. The projections can take the form of tongues, for example, which are cut out of the heddle body and bent outward on the side. The projections can furthermore be elements that are attached later on to the flat side of the heddle body. Such elements can be attached by laser-welding, for example, or can also be riveted on in the form of sheet metal brackets, wherein the welding seams can extend either transverse to or in longitudinal direction of the heddle body. The version where the welding seam is oriented in longitudinal direction results in especially high stability for the end eyelet formed this way.

One preferred embodiment focuses special attention onto the design of the thread-guiding surfaces, wherein these can take the form of plates that are bent out of the thread eyelet. The freely projecting plates of one preferred embodiment are bent outward, thereby forming an angle of at least 110° to the thread eyelet. As a result, generously dimensioned thread-guiding surfaces are obtained, which can be used for weaving even brittle threads that are sensitive to breakage.

In particular for the processing of strongly adhering or abrasive threads, the thread-guiding surfaces are advantageously embodied on separate elements, which are connected to the heddle body, thus forming the upper and/or lower edge of the thread eyelet. The special elements can consist of hardened steel, hard alloy, plastic or ceramic material and can be connected to the heddle body by gluing, welding or soldering them on. The use of hard alloy or ceramic material permits the weaving of particularly aggressive bands, such as those composed of aramide fibers. The additional elements can furthermore be provided with sections, which protect at least a portion of the side edges of the thread eyelet. This can be achieved by embodying the elements as pins that are provided on the ends with disks or plates. It is furthermore advantageous if the heddle is provided in the region of the thread eyelet with a resistant material support, for example consisting of titanium nitride or a different type of mechanically resistant material. If hard alloy elements are used for forming the thread guiding surfaces, this support can be restricted to the hard alloy elements.

For an extremely cost-effective embodiment of the heddle according to the invention, the elements clearly project over the upper and lower edge of the thread eyelet. The elements are embodied as small lamina, which are arranged on the flat sides of the heddle body and have well-rounded edges. These lamina are attached to the flat sides on the front and the back of the heddle body and, based on their positioning, determine the height of the thread eyelet in longitudinal direction of the heddle. With this measure, thread eyelets of varying height can be realized on uniformly stamped out heddle bodies, so that the respective heddles can be equipped for different band-shaped warp threads.

Further details of advantageous embodiments of the invention are the subject matter of the drawing, the specification, or the claims.

BRIEF DESCRIPTION OF THE DRAWINGS

Exemplary embodiments of the invention are illustrated in the drawing and show in.

DETAILED DESCRIPTION OF THE INVENTION

Figure 1:
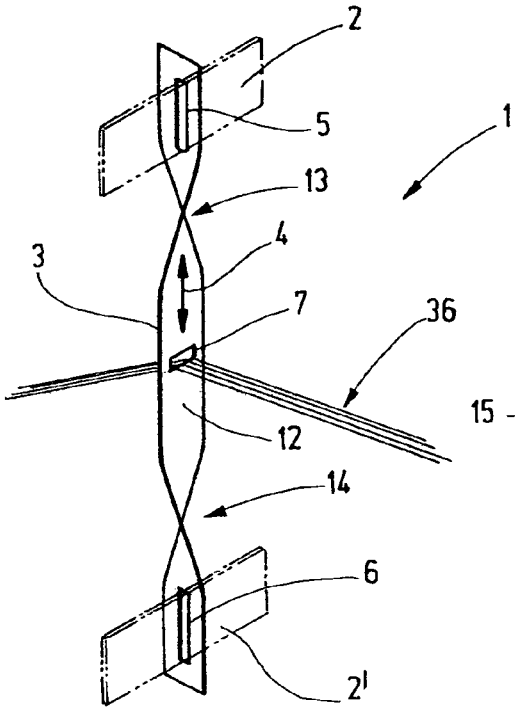
FIG. 1 A perspective, detailed diagram of a weaving shaft with heddle.

FIG. 1 shows a heddle 1 for flat, band-shaped warp threads that are not shown in further detail. The heddle 1 belongs to a group of identically or similarly embodied heddles positioned on a weaving shaft, such as is used for forming sheds on a weaving loom. The heddle 1 is positioned on two heddle support rails 2, 2', which are arranged at a distance to each other and are held on the upper and the lower shaft bar of a weaving shaft. The heddle 1 comprises a basic body 3, composed of sheet steel strips, for which the longitudinal direction 4 in FIG. 1 is oriented vertically and thus at a right angle to the heddle support rails 2, 2'. At its ends, it is provided with end eyelets 5, 6 that are formed in the simplest case by openings punched out of the basic body 3, which correspond in form and size to the cross section of the heddle support rails 2, 2' with a correspondingly added play. In a region disposed between the end eyelets 5, 6, the basic body 3 is provided with a thread eyelet 7 for holding a warp thread. The thread eyelet 7 has an essentially rectangular cross section, as shown in particular in FIG. 2, wherein its side edges 8, 9 which extend in longitudinal direction 4 are shorter than its upper and lower edges 10, 11 that extend transverse to the longitudinal direction 4.

FIG. 1 shows that a flat, substantially planar region 12 surrounds the thread eyelet 7 and is positioned approximately in or parallel to a plane determined by the heddle support rails 2, 2'. For this, the heddle 1 is twisted between the region 12 and the respective end eyelet 6, 7 by about 90° around the longitudinal direction 4, respectively at the locations 13, 14.

Figure 2:
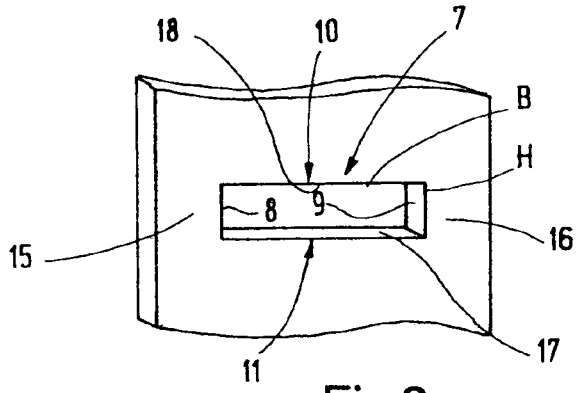
FIG. 2 The heddle according to FIG. 1, showing a detailed, perspective view of its thread eyelet.

FIGS. 1 and 2 show that the heddle body is an integrally formed, flexible stamped part of a relatively thin, flat metal such as steel. The end eyelets 5, 6 are components of the heddle body 3. The width of the heddle body 3, however, is always wider than the width B shown in FIG. 2 for the thread eyelet 7, at least in the region 12 but preferably on the whole. On both sides of the thread eyelet 7, webs 15, 16 remain, wherein these are preferably slightly wider than the thickness of the flat material from which the heddle 1 is formed. The height H of the thread eyelet 7 to be measured in longitudinal direction 4 is clearly less than its width B. The thread eyelet 7, however, can also have an oval form or a different form that deviates from the rectangular form shown in FIG. 2, wherein its width B respectively exceeds its height H.

The upper and the lower edge 10, 11 are preferably formed with the thread guiding surfaces 17, 18 which can directly adjoin the flat sides of the region 12, as shown in FIG. 2. However, the transitions can also be rounded, so as to protect sensitive warp threads 36. The warp threads 36 can respectively be individual threads and/or strips (e.g. plastic bands) or can be composed of several threads that are either connected or not connected, an arrangement of threads, or also a thread band 36.

The heddle 1 described so far operates as follows:

For the operation of a weaving loom and in order to form a weaving shed, several heddles 1 are lined up on the heddle support rails 2, 2' of at least two weaving shafts, as shown for the embodiment in FIG. 1. In the simplest case, the heddles 1 are embodied to be identical. On each weaving shaft, they are spaced apart by a distance that essentially corresponds to the warp thread width 36. The band-shaped warp threads 36 used for the shed forming run through the thread eyelets 7. For the shed forming, the two weaving shafts with the heddles 1 supported by the heddle support rails 2, 2' are moved up and down in longitudinal direction 4. In the process, the band-shaped warp threads 36, which run through the thread eyelets 7 are deflected without being deformed toward the top and the bottom to form a shed, which is used for inserting the weft of a warp thread.

According to a modified embodiment, the regions 12 of the heddles 1 are not precisely turned by 90° relative to the end eyelets 5, 6. The heddles 1 of the first and second weaving shaft thus can overlap somewhat, thereby making it possible to create a denser textile. For this embodiment, the clear width as seen from the warp thread 36 also exceeds at least slightly the width of the flat warp thread 36.

Figure 3A:
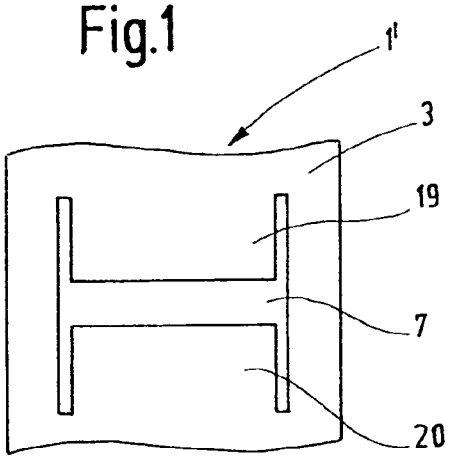
FIGS. 3*a* and 3*b* A modified embodiment of the thread eyelet of a heddle in a view from above, following the stamping out of the heddle (FIG. 3*a*), showing a vertical sectional view after the completion of the thread eyelet (FIG. 3*b*)
Figure 3B:
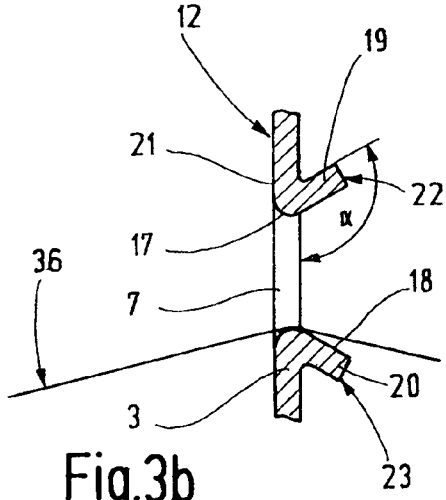

It is furthermore possible to embody the heddle 1 slightly asymmetrical, either by stamping in the openings for the end eyelets 5, 6 off center into the heddle body 3, or by bending the twisted regions and/or the turning regions 13, 14 in a somewhat asymmetrical manner. FIGS. 3*a* and 3*b* illustrate a modified embodiment of the heddle 1, for which the above explanation applies, with the exception of the following modifications and completions. The thread eyelet 7 again has a substantially rectangular design. However, it is initially stamped out in the shape of a H, as shown with FIG. 3*a*, so that an upper and a lower flap 19, 20 is exposed, wherein these flaps extend toward each other. The flaps 19, 20 are then bent away from each other, as shown with FIG. 3*b*. In the process, they can be bent out from the thread eyelet 7 either toward the same side or toward opposite sides, thereby forming a wedge-shaped or funnel-shaped thread eyelet. They are preferably bent at an angle that clearly exceeds 90°, wherein the preferred exemplary embodiments use an angle $\alpha$ between 110° and 150°. The flaps 19, 20 herein can be oriented in thread running direction or counter to the running direction of the warp threads 36. In each case, thread guiding surfaces 17, 18 are formed that start at one flat side 21 of the region 12, as shown in FIG. 3*b*, and respectively extend to the exposed end 22, 23 of each flap 19, 20. The corresponding length to be measured thus exceeds the thickness of the heddle body 3. This embodiment is particularly suitable for use with band-shaped warp threads 36 composed of a sensitive, but not very abrasive material.

It must be pointed out here that the heddle 1', as well as all heddles 1' described in the following, are provided with a thread eyelet 7 having a height H, which is lower than the width B. However, the heddles 1' of these embodiments without exception can also be provided with eyelets 7, having a height H that exceeds the width B.

Figure 4A:
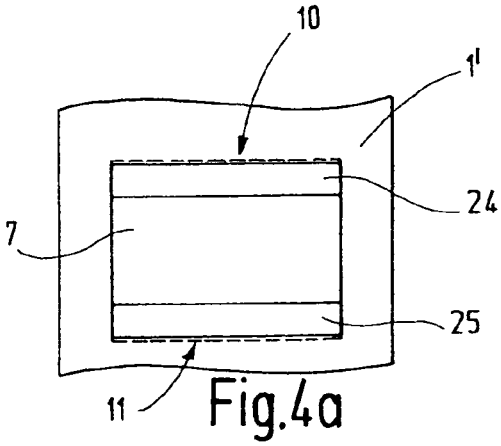
FIGS. 4*a* and 4*b* A modified embodiment of a thread eyelet with elements for determining thread guiding surfaces, shown in a view from above (FIG. 4*a*) and as a vertical section (FIG. 4*b*)
Figure 4B:
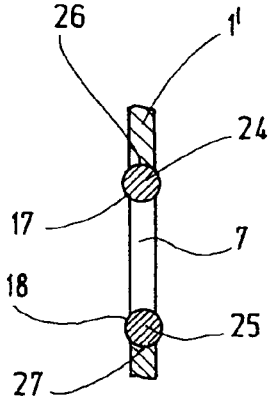

A different embodiment of the heddle 1' is illustrated in FIGS. 4*a*, 4*b*. This embodiment is provided with the special feature of having thread guiding elements 24, 26 that edge the thread eyelet 7 on the top and on the bottom, thus forming an upper and lower edge. The thread guiding elements 24, 25 are embodied, for example, as cylinder-shaped pins, positioned inside corresponding recesses 26, 27 that are formed on the edges 10, 11, wherein these recesses can be ring-shaped. The thread elements 24, 25 preferably have a diameter that exceeds the thickness of the heddle body 3. The length of the thread guiding surfaces 17, 18, which are embodied on the thread guiding elements 24, 25, consequently exceeds the thickness of the heddle body 3.

Figure 10A:
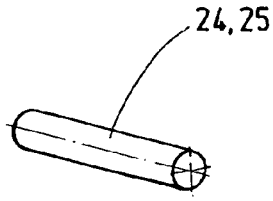
FIG. 10*a* A thread guiding element for a heddle according to FIGS. 4*a*, 4*b*, or alternatively FIGS. 9*a*, 9*b;*
Figure 10B:
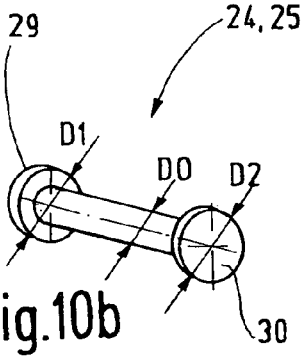
FIG. 10*b* A thread guiding element for the heddle according to FIGS. 4*a*, 4*b* or alternatively FIGS. 9*a*, 9*b;*

The thread guiding elements 24, 25 are preferably embodied identical and can consist, as shown in FIG. 10*a*, of a suitable material such as hardened steel, hard alloy, ceramic, or a different wear-resistant material. These elements can be soldered, welded, or glued to the heddle body 3. The thread guiding element 24, 25 can furthermore be made of a plastic material. The selection of the material for the thread-guiding element 24, 25 can be based on the type of warp thread that must be guided by the thread eyelet 7.

Figure 5A:
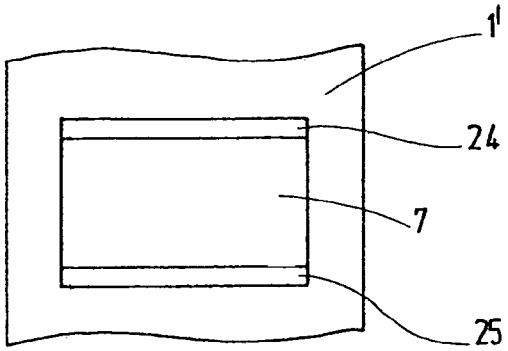
FIGS. 5*a* and 5*b* A different embodiment of a thread eyelet with elements for forming thread guiding surfaces, showing a view from above (FIG. 5*a*) and as a vertical section (FIG. 5*b*)
Figure 5B:
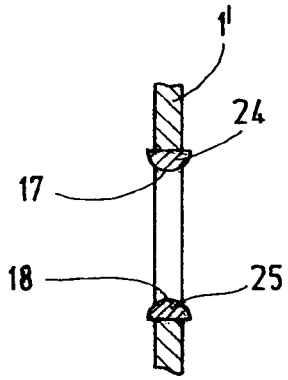

FIGS. 5*a*, 5*b* illustrate a modified embodiment of the heddle 1', wherein the thread guiding elements 24, 25 have a partial-cylindrical, preferably semi-round cross section. This shape considerably simplifies the positioning of the thread guiding element 24, 25 and the fastening of said element to the heddle body 3. Otherwise, the above description provided for the exemplary embodiment according to FIGS. 4*a*, 4*b* applies correspondingly to the embodiment according to FIGS. 5*a*, 5*b*.

Figure 6A:
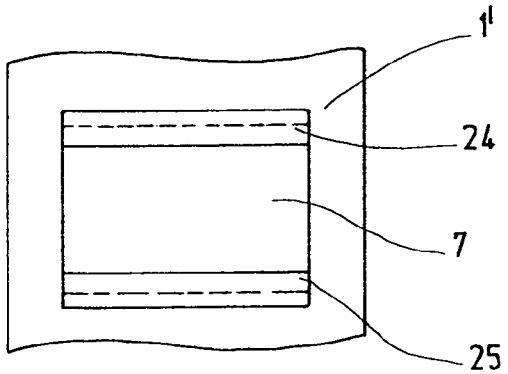
FIGS. 6*a* and 6*b* A thread eyelet with positively interlocking support elements for determining the thread guiding surface, in a view from above (FIG. 6*a*) and as a vertical section (FIG. 6*b*)
Figure 6B:
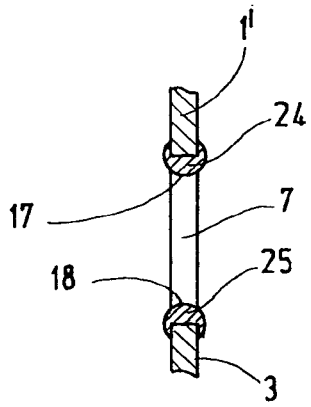

FIGS. 6*a*, 6*b* illustrates yet another modified embodiment of the heddle 1'. This embodiment comprises thread guiding elements 24, 25, which have a basic cylindrical shape and are each provided on the sides facing away from the thread eyelet 7 with a groove for accommodating the heddle body 3. In this way, the thread guiding elements 24, 25 can be attached easily and securely to the heddle body 3, wherein a material-to-material connection achieved through gluing, soldering, or welding is preferred. Otherwise, the above explanations apply.

Figure 7A:
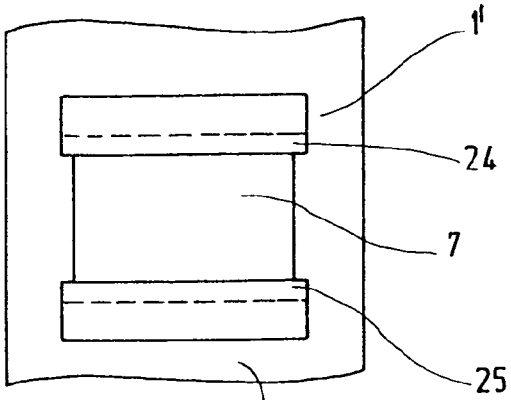
FIGS. 7*a* and 7*b* A modified embodiment of the thread eyelet for a heddle, with elements embodied as lamina, for forming thread guiding surfaces, shown in a view from above (FIG. 7*a*) and as a vertical section (FIG. 7*b*)
Figure 7B:
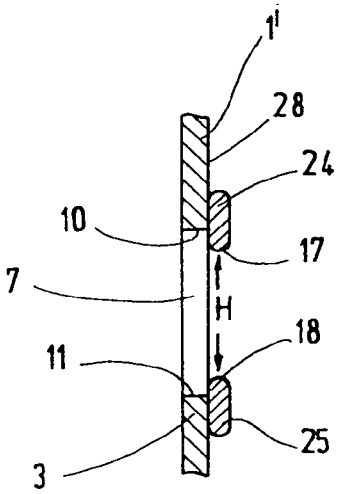

FIGS. 7*a*, 7*b* show a different embodiment of the heddle 1' according to the invention. The special feature of the heddle body 3 for this heddle is that it is provided on its flat side 28 with thread guiding elements 24, 25 in the form of flat rods, which overlap the upper edge 10 and the lower edge 11 of the thread eyelet 7. The thread guiding surfaces 17, 18 formed by the rounded edges of the thread guiding elements 24, 25 consequently delimit the clear height H of the thread eyelet 7, wherein this clear height H is noticeably smaller than the distance measured in the same direction between the edges 10, 11. The area projecting over the edges 10, 11 of the thread guiding elements 24, 25 is preferably large enough to prevent the warp thread from coming into contact with the edges 10, 11, wherein this area of the thread guiding elements 24, 25 that projects over the edges 10, 11 is preferably large enough, so that the warp thread does not reach the edges 10, 11 even in the shed-forming position, meaning the position where the weaving shaft has reached the extreme upper or lower position.

Figure 8A:
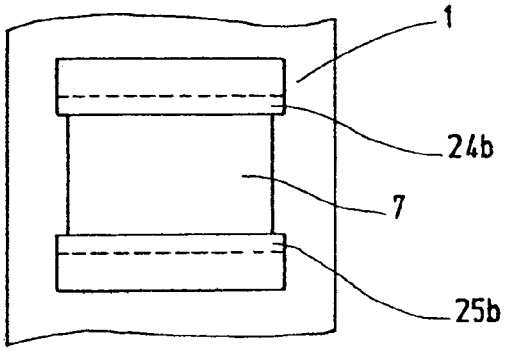
FIGS. 8*a* and 8*b* An embodiment of a heddle with widened thread support surface, shown in a view from above (FIG. 8*a*) and as a vertical section (FIG. 8*b*)
Figure 8B:
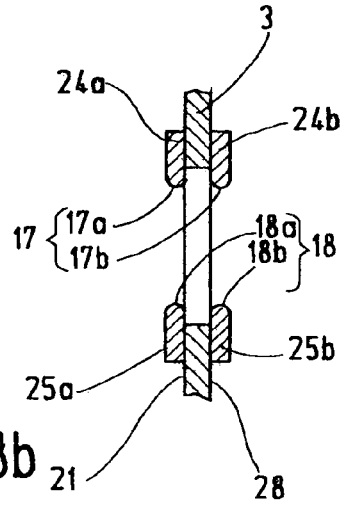

As shown with FIGS. 8*a* and 8*b*, the corresponding thread guiding elements 24*a*, 24*b*, 25*a*, 25*b* can also be attached to both flat sides 21, 28 of the heddle body 3, thereby creating thread guiding surfaces 17, 18, which are respectively divided into partial surfaces 17*a*, 17*b*, 18*a*, 18*b*. The total width of these thread guiding surfaces 17, 18 then exceeds the thickness of the heddle body 3, wherein this total width is understood to be the width of the individual partial surfaces 17*a*, 17*b*, 18*a*, 18*b*, including the respective spaces between the partial surfaces 17*a*, 17*b* and/or 18*a*, 18*b*.

As shown, the thread guiding elements 24, 25 of the exemplary embodiment according to FIGS. 7*a*, 7*b* as well as those of the embodiment shown in FIGS. 8*a*, 8*b* can be embodied as separate elements or, alternatively, also as part of a frame that is fitted flat onto the flat sides 21 and/or 28. The frame in that case determines the geometry of the thread eyelet 7. However, the embodiment with separate, non-connected thread elements 24, 25 is preferred. The webs remaining on both sides of the thread eyelet 7 can be flexible or resilient, wherein glued-on, soldered-on, or welded-on elements do not present obstacles, for example, or cause the breakage of a ceramic thread guiding element. On the other hand, with the solution using frame-type thread guiding elements, the thread eyelet region of the heddle body 3 can be reinforced.

Figure 9A:
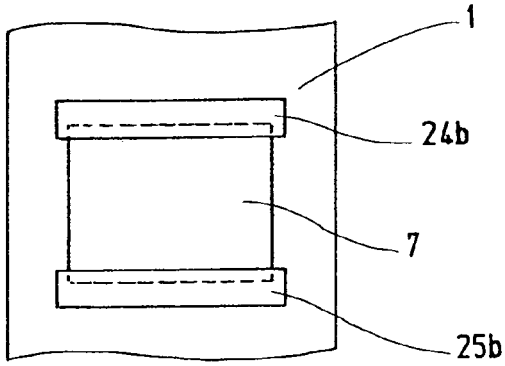
FIGS. 9*a* and 9*b* A modified embodiment of the heddle with round thread-guiding elements in the thread eyelet, in a view from above (FIG. 9*a*) and as a vertical section (9*b*)
Figure 9B:
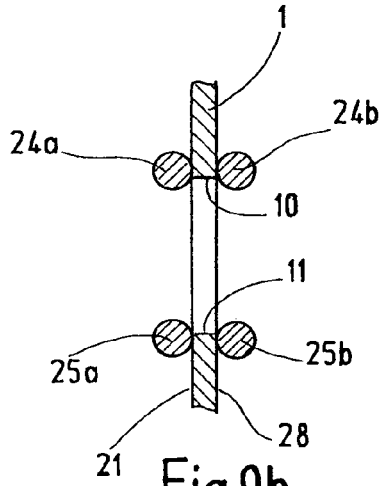

FIGS. 9*a* and 9*b* illustrate a different embodiment, which is based on the one shown in FIGS. 8*a*, 8*b* and differs from the above embodiment by the shape for the thread guiding elements 24*a*, 24*b*, 25*a*, 25*b*. The thread guiding elements 24*a*, 24*b*, 25*a*, 25*b* in this case are embodied as cylindrical pins, as shown in FIG. 10*a*. They are attached to the flat sides 21, 28 and project over the edges 10, 11. The band-shaped warp thread runs over the thread guiding elements 24*a*, 24*b*, 25*a*, 25*b* without coming in contact with the edges 10, 11.

The thread guiding elements 24, 25 of the aforementioned embodiments can also be embodied as cylindrical pins with buffer elements 29, 30 at the ends, wherein these buffer elements 29, 30, for example, can be disk-shaped sections having a diameter D1, D2 that exceeds the diameter D0 of the cylinder-shaped central section of the pin. The buffer elements 29, 30 can be provided with a flattened area on one side, designed to make it easier to attach the heddle body 3 to one of the flat sides 21, 28.

Figure 11:
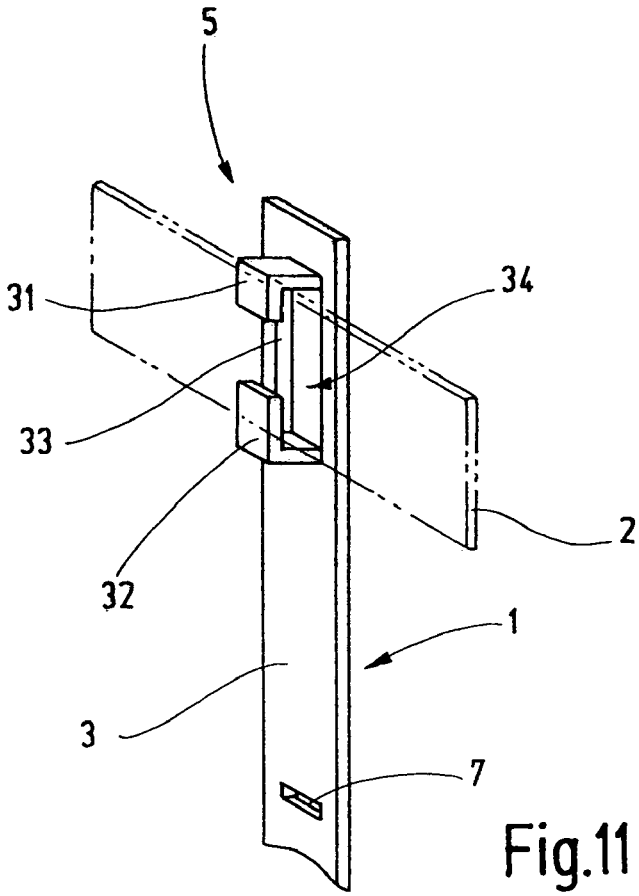
FIG. 11 The heddle according to FIG. 1 with a modified embodiment of an end eyelet, without turning of the heddle body, shown in a perspective representation and FIG. 12 A modified embodiment of the end eyelet in a schematic representation.

FIG. 11 illustrates an alternative embodiment of the end eyelet 5 for the heddle 1, which is suitable for all aforementioned embodiments. The end eyelet 5 includes projections 31, 32 that are designed to encircle the heddle support rail 2, thereby securing the heddle 1 on the heddle support rail 2. For the present embodiment, the projections 31, 32 are embodied as angled tongues, which are stamped out when punching out the opening 33. The tongues are then bent out of this opening 33 and angled toward each other at the ends, such that they form hooks that extend over the heddle support rail 2. This type of embodiment has the advantage that the heddle body 3 fits flat against the support rail 2 and thus cannot be turned. The opening 34 for accommodating the heddle support rail 2, which opening is defined by the projections 31, 32, has considerable vertical play relative to the heddle support rail 2, but only a slight play otherwise.

Figure 12:
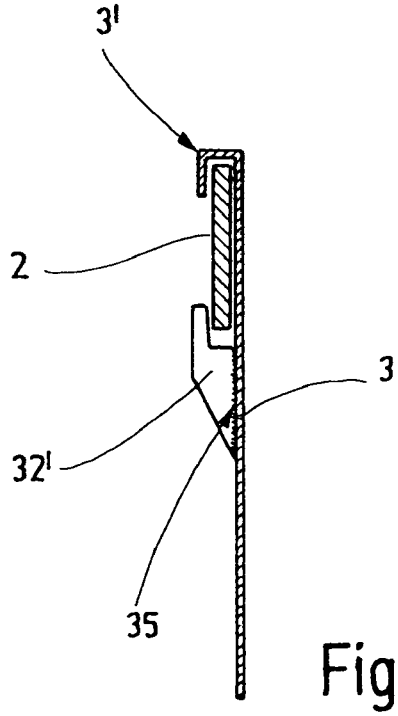

The embodiment of the end eyelet 5 as shown in FIG. 11 can be changed, for example, in that the upper projection 31 is replaced by correspondingly bending over the end 31' of the heddle body 3, as shown schematically in FIG. 12. Also, the projection 32 according to FIG. 12 can be replaced with a fitted-on or welded-on sheet metal section 32', which is connected to the heddle body 3 on a vertically oriented edge 35. The element 32' can be formed by bending over an edge section of the heddle body 3, or can be attached separately thereto.

A heddle 1 for flat, band-shaped warp threads 36 is provided with a thread eyelet 7, having a width that is preferably wider than its height. A thread eyelet 7 of this type prevents a deformation of the band-shaped warp thread 36, in particular a pushing together of the sides during the shed formation. The heddle 1 according to the invention is furthermore preferably provided with thread guiding surfaces 17, 18, for which the length exceeds the thickness of the heddle 1 body 3, relative to the running direction of the warp thread 37. As a result of this measure, it is possible to reduce wear to the heddle 1 as well as the warp thread 36.

REFERENCE NUMBER LIST

1 heddle
2, 2' heddle support rail
3 basic body
4 longitudinal direction
5, 6 end eyelets
7 thread eyelet
8, 9, 10, 11 edges
12 region
13, 14 positions, turning positions
15, 16 webs
17, 18 thread guiding surfaces
17*a*, 17*b*, 18*a*, 18*b* partial surfaces
19, 20 flaps
21 flat side
22, 23 end
24, 25, 24*a*, 24*b*, 25*a*, 25*b* thread guiding elements
26, 27 recesses
28 flat side
29, 30 buffer elements on the ends
31, 32 projections
31' bent-over ends
32' sheet metal element
33 opening

34 accommodating opening
35 edge
B width
H height
D0, D1, D2 diameter

The invention claimed is:

1. A heddle for band-shaped warp threads comprising, a heddle body that extends in a longitudinal direction and is provided on at least one end with an end eyelet for positioning it on a heddle support rail, a rectangular thread eyelet provided on the heddle body, and having an upper edge and a lower edge, wherein these edges are spaced apart in the longitudinal direction, wherein only the upper edge and the lower edge form a thread guiding surface, which is embodied rounded on the thread inlet side and/or the thread outlet side, and wherein the length of the guiding surface extending in a warp thread movement direction exceeds the thickness, measured in the same direction, of the heddle body at the thread eyelet.

2. The heddle according to claim 1, wherein the thread eyelet determines an opening direction in a single plane and is defined by the longitudinal direction of the heddle body and the warp thread that moves through the thread eyelet.

3. The heddle according to claim 1, wherein the heddle body comprises a band-shaped material and is oriented transverse to the warp thread movement direction, at least at its thread eyelet.

4. The heddle according to claim 3, wherein the heddle body is twisted between its end eyelet and its thread eyelet.

5. The heddle according to claim 1, wherein the end eyelet is a separate element that is connected to the heddle body or is formed as one piece with the heddle body.

6. The heddle according to claim 1, wherein the heddle body is composed of a flat material that extends at the end eyelets parallel to a heddle support rail and is held thereon by projections, which are attached to the heddle body and project over its flat side.

7. The heddle according to claim 1, wherein flaps that are bent out of the heddle body at the thread eyelet form the thread guiding surface.

8. The heddle according to claim 1, wherein the thread guiding surface is formed on thread guiding elements that are connected to the heddle body.

9. The heddle according to claim 8, wherein at least one of the thread guiding surfaces is divided into two partial surfaces, respectively embodied on one of the thread guiding elements.

10. The heddle according to claim 8, wherein the thread guiding elements are made of plastic, a hard alloy, or a ceramic material.

11. The heddle according to claim 1, wherein the upper and lower edges are longer edges of the rectangular thread eyelet.

* * * * *